US005838761A

United States Patent [19]

Behner et al.

[11] Patent Number: 5,838,761

[45] Date of Patent: Nov. 17, 1998

[54] X-RAY TUBE WITH GETTER

[75] Inventors: Heinrich Behner, Moehrendorf; Thomas Weller, Erlangen, both of Germany

[73] Assignee: Siemens Aktiengesellschaft, Munich, Germany

[21] Appl. No.: 848,873

[22] Filed: May 1, 1997

[30] Foreign Application Priority Data

May 6, 1996 [DE] Germany ..... 196 18 135.6
Mar. 27, 1997 [DE] Germany ..... 197 13 076.3

[51] Int. Cl.[6] ..... H01J 35/20

[52] U.S. Cl. ..... 378/123; 378/210

[58] Field of Search ..... 378/123

[56] References Cited

U.S. PATENT DOCUMENTS 2,341,483 2/1944 Stephen ..... 378/123
3,735,176 5/1973 Langer et al. ..... 378/123
4,668,424 5/1987 Sandrock .

FOREIGN PATENT DOCUMENTS 2 077 487 12/1981 United Kingdom .

OTHER PUBLICATIONS

Patent Abstracts of Japan (E–901), Mar. 12, 1990, vol. 14, No. 130, for Japanese Application No. 63–152340.

Patent Abstracts of Japan (M–69), Aug. 17, 1979, vol.3/No. 97, for Japanese Application No. 52–138699.

English Abstract for Japanese Application No. 52–47909.

*Primary Examiner*—Craig E. Church
*Attorney, Agent, or Firm*—Hill & Simpson

[57] ABSTRACT

X-ray tube with an anode and a cathode arranged in a vacuum housing has two getters in the inside of the vacuum housing for bonding free gases. One getter is disposed at a location in the vacuum housing neighboring the anode at which a relatively high temperature prevails during operation, and the other getter is disposed at a location at which a comparatively low temperature prevails during operation.

6 Claims, 4 Drawing Sheets

X-RAY TUBE WITH GETTER

BACKGROUND OF THE INVENTION

1. Field of the Invention

The present invention is directed to an x-ray tube with an anode and a cathode arranged in a vacuum housing, and getters inside the housing for bonding free gases.

2. Description of the Prior Art

Various components are usually present in the inside of a vacuum housing of an x-ray tube which give off various gases during operation of the x-ray tube as a consequence of temperature influences. These gases adhere to the surfaces of the components or diffuse out of their interiors. This process, which is generally referred to as outgassing, negatively influences the high-voltage strength of the x-ray tube, and thus its functionability since higher-voltage arcing can occur as a consequence of the free gases in the vacuum space of the x-ray tube. In the worst case, this can lead to damage to or destruction of the x-ray tube.

There is therefore the necessity of bonding the gases released into the inside of the vacuum space during operation of the x-ray tube in order to avoid high-voltage arcing. This is usually accomplished with getters that are integrated in the inside of the vacuum housing of the x-ray tube and have the effect of bonding gases released into the vacuum space of the x-ray tube, i.e. absorbing them into the inside of the getter material.

For bonding gases released in the vacuum housing of the x-ray tube, x-ray tubes are currently constructed with only one getter, usually built into the inside of the vacuum housing, this getter bonding gases released in the vacuum housing partially with chemical bonds with the getter material and partially by the gases physically entering into solution in the getter material. Experience has shown that the getter in such known x-ray tubes can only partially bond the released gases.

For example, Japanese Published Application 1 32 07 47 discloses such an x-ray tube that contains a getter that is directly heated with the filament current and is arranged in a housing projection. British specification 2 077 487 and U.S. Pat. No. 4,668,424 disclose getter materials for getters for chemical bonding, or for physical solution of gases.

SUMMARY OF THE INVENTION

An object of the present invention is to provide an x-ray tube of the type initially described wherein the bonding of gases released in the inside of the vacuum housing of the x-ray tube is improved.

According to the invention, this object is achieved in an x-ray tube having an anode and a cathode arranged in a vacuum housing and two getters in the inside of the housing for bonding free gases, with the one getter disposed at a location in the vacuum housing neighboring the anode at which a relatively high temperature prevails during operation, and the other getter disposed at a location at which a comparatively lower temperature prevails during operation. The invention is based on the recognition that reactive gases can usually be well-bonded by getter materials that enter into strong chemical bonds with these gases. These gases are first absorbed at the getter surface and subsequently diffuse into the inside of the getter, where they are durably bonded, the diffusion process occurring faster at elevated getter temperature. The absorbency of such a getter for reactive gases, i.e. the number of bonds of gas molecules in the inside of the getter per time unit, thus becomes greater as the operating temperature of the getter increases, but this is only valid up to a getter-specific limit temperature.

The invention also is based on the recognition that other gases enter into largely physical solution in suitable getter materials, the solution of these gases in getters of such getter materials usually decreasing with increasing operating temperature. The solution process of these gases in such a getter thus occurs relatively rapidly at comparatively low getter temperature and decelerates with increasing getter temperature, so that absorbency of the getter with respect to these gases deteriorates at relatively elevated temperature.

Since, in the inventive x-ray tube, the one getter also exhibits a relatively high operating temperature as a result of a relatively high ambient temperature because of its integration in the vacuum housing of the x-ray tube in the proximity of the anode, freely reactive gases that were first absorbed at the getter surface can thus usually quickly diffuse into the inside of the getter due to the elevated temperature of this getter. Therefore, these gases durably become bonded in the getter, so that this getter exhibits a good absorbency with respect to the reactive gases. By contrast, the other getter, which exhibits a relatively low operating temperature because of its location in the vacuum housing of the x-ray tube, is able to rapidly and effectively dissolve those free gases that physically enter into solution, given the comparatively low temperature in the getter material. The integration locations of both getters in the vacuum housing of the x-ray tube are thus selected in view of the operating temperature of the getters so that they respectively develop an optimally high absorbency.

Japanese Published Application 53 13 51 87 discloses a high-voltage sodium lamp that has a getter arranged in an outside bulb of the sodium lamp at a location with high temperature, and a getter arranged in another outside bulb at a location of low temperature.

Japanese Published Application 5471 885 discloses a discharge lamp that has two getters in an outside bulb of the discharge lamp, with the one getter is arranged at a location of high temperature and the other getter is arranged at a location of low temperature.

In various versions of the inventive x-ray tube, the vacuum housing of the x-ray tube has a housing projection accepting the cathode in which the lower temperature getter is arranged, and/or the x-ray tube has a cathode cup accepting the cathode in which the lower temperature getter is arranged, and/or the x-ray tube has a cathode arrangement with a projection that is provided with a cathode cup that accepts the cathode, with the lower temperature getter arranged at that side of the projection facing away from the anode, and/or the lower temperature getter is arranged at that side of the anode facing away from the cathode.

Each of the above embodiments of the inventive x-ray tube has the advantage that the getter which exhibits a relatively low temperature due to its integration location in the vacuum housing of the x-ray tube is able to rapidly and effectively dissolve those free gases that physically enter into solution, given a comparatively low temperature in the getter material. In an embodiment of the invention the getters be executed of different getter materials. Zirconium, alloys of zirconium, vanadium and iron, alloys of zirconium and carbon or alloys of zirconium and aluminum, which are effective for reactive gases such as carbon monoxide, nitrogen, oxygen, water and carbon dioxide, are suitable as getter materials for the higher temperature getter.

Zirconium, alloys of zirconium, vanadium and iron, alloys of zirconium and carbon, alloys of zirconium and aluminum and alloys of zirconium and nickel are suitable for the lower temperature getter. Non-reactive gases, namely hydrogen, physically enter into solution well in these getter materials.

DESCRIPTION OF THE PREFERRED EMBODIMENTS

Figure 1:
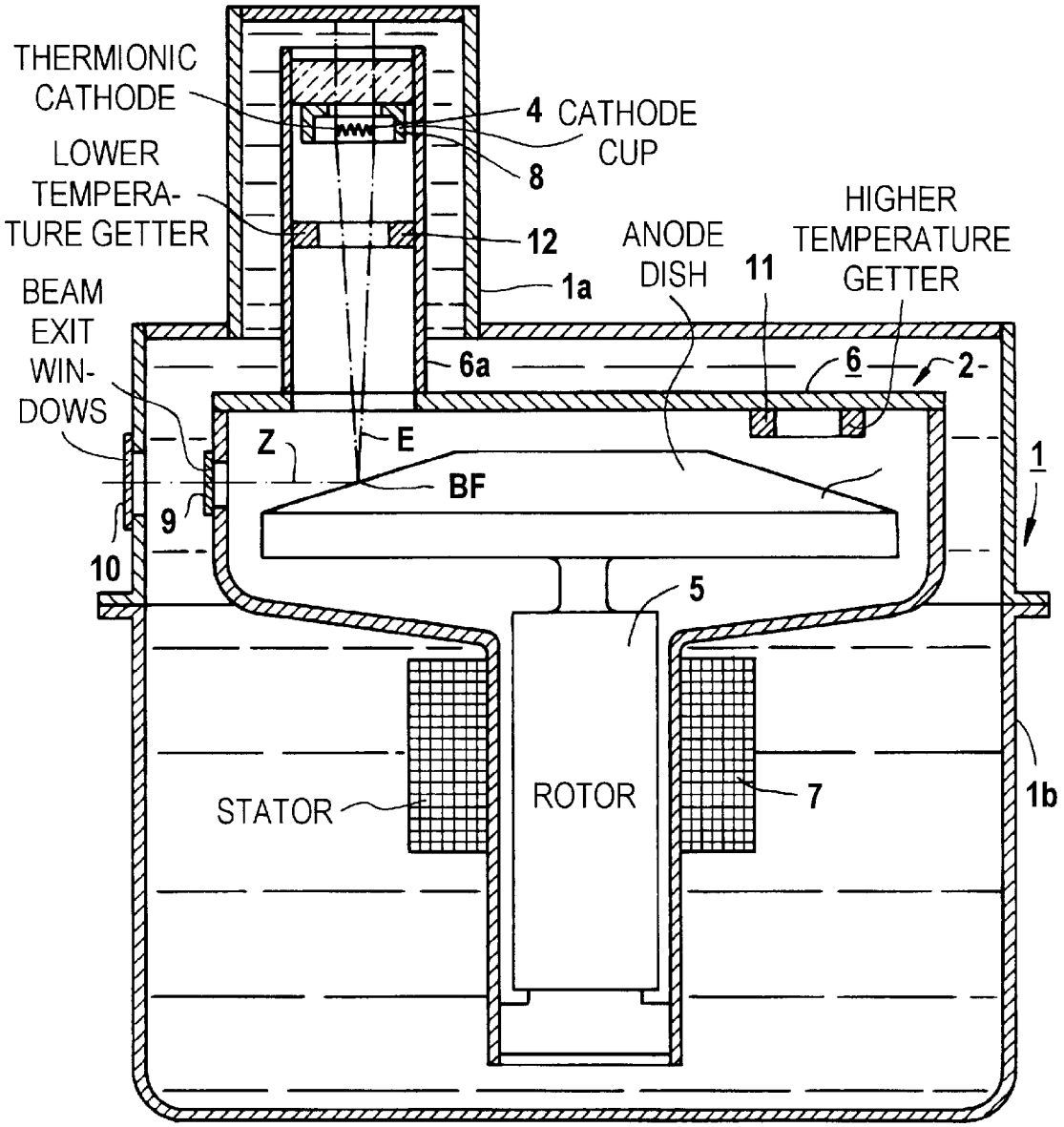
FIG. 1 is a longitudinal section in a schematic illustration through an x-ray radiator containing an inventive x-ray tube in a first embodiment.

FIG. 1 shows an x-radiator having a protective housing 1 filled with an electrically insulating medium, for example insulating oil, composed of two shells 1*a* and 1*b* and containing an inventive x-ray tube 2 therein. The x-ray tube 2 is a rotating anode x-ray tube and has a vacuum housing 6 accepting an anode dish 3, a stationary glow cathode 4 and a motor for driving the anode dish 3. The motor is fashioned as a squirrel-cage induction motor and has a rotor 5 connected to the anode dish 3 and a stator 7 put in place on the vacuum housing 6 in the region of the rotor 5. The anode dish 3 and the rotor 5 are rotatably seated—in a way not shown in detail—in the inside of the vacuum housing 6, which is a metal-ceramic housing composed of several parts.

In its upper region, the vacuum housing 6 is provided with a housing projection 6*a* in FIG. 1 in which the glow cathode 4 is located, that is accepted in the focusing slot of a schematically indicated cathode cup 8 is located.

The terminals for the tube voltage, the filament voltage and the supply voltage for the stator 7 are not shown and are implemented in a known way.

The electron beam E emanating from the glow cathode 4 during operation strikes the frustum-shape incident surface of the anode dish 3 in a focal spot BF. An x-ray beam emanates from the focal spot BF, only the central array Z thereof being indicated in FIG. 1. The useful x-ray beam emerges from the x-ray radiator through a first radiation exit window provided in the vacuum housing 6 and through a second radiation exit window 10 aligned therewith in the protective housing 1.

For bonding free gases that, after the evacuation of the vacuum housing 6, are released into the interior of the vacuum housing from various components which are present in the inside of the x-ray tube 2 as a consequence of temperature caused outgassing during operation of the x-ray tube 2, two annular getters 11 and 12 are provided in the inside of the vacuum housing 6.

The getter 11 is thereby formed of zirconium, zirconium being a getter material that enters into strong chemical bonds with reactive gases such as carbon monoxide, nitrogen, oxygen, water and carbon dioxide that are usually released into the inside of the vacuum housing 6 during operation of the x-ray tube 2. The getter 11 first absorbs these gases at its getter surface, from which the gases proceed into the inside of the getter 11 by diffusion, where they are durably bonded. Since the diffusion process of the gases occurs faster from the getter surface into the inside of the getter 11 at an elevated temperature of the getter 11, thereby increasing the absorbency of the getter 11, the getter 11 is secured to the wall of the vacuum housing 6 opposite the anode dish 3. During operation of the x-ray tube 2, the anode dish 3 is heated to temperatures of up to about 1000° C. as a consequence of the incidence of the electron beam E on the incident surface of the anode dish 3. The anode dish 3 thus emits the heat generated in this way to the environment as thermal radiation, and thus to the getter 11 as well. The getter 11 is thus indirectly heated by the thermal radiation of the anode dish 3 and thereby reaches an operating temperature of approximately 400°–500° C., so that the diffusion process of the reactive gases absorbed at the getter surface into the inside of the getter 11 is accelerated.

The acceleration of the diffusion process of reactive gases from the getter surface into the inside of the getter 11 as a consequence of an elevated operating temperature of the getter 11, however, is dependent on the getter material only up to a specific limit temperature that lies at about 900° C. for a zirconium getter like the getter 11. Above the limit temperature, an increase in the absorbency of the getter is usually no longer possible.

Compared thereto, the getter 12 is formed of an alloy of zirconium and nickel, the alloy of zirconium and nickel being a getter material in which hydrogen, which is likewise present as a free gas in the inside of the vacuum housing 6 during operation of the x-ray tube 2, enters physically into solution well. Since the solution process of the hydrogen in the getter 12 also occurs rapidly at comparatively low operating temperatures of the getter 12 and slows down with increasing operating temperature of the getter 12, causing of the absorbency of the getter 12 with respect to hydrogen to deteriorate, the getter 12 is secured approximately in the middle of the housing projection 6*a* of the vacuum housing 6, being secured to the wall of the vacuum housing 6*a*. The integration location of the getter 12 is thus selected such that the getter 12 is heated only comparatively little by the thermal radiation of the anode dish 3 and by the heated glow cathode 4, and has a temperature of approximate 250° C.

It is thus assured that hydrogen enters relatively rapidly into solution in the getter 12, as a result of which the partial hydrogen pressure in the inside of the vacuum housing 6 of the x-ray tube 2 is kept low. The level of the partial hydrogen is dependent on the getter material, the hydrogen concentration in the getter 11 and on the temperature.

The getters 11 and 12 need not necessarily have an annular shape but can also be shaped in some other way.

Figure 2:
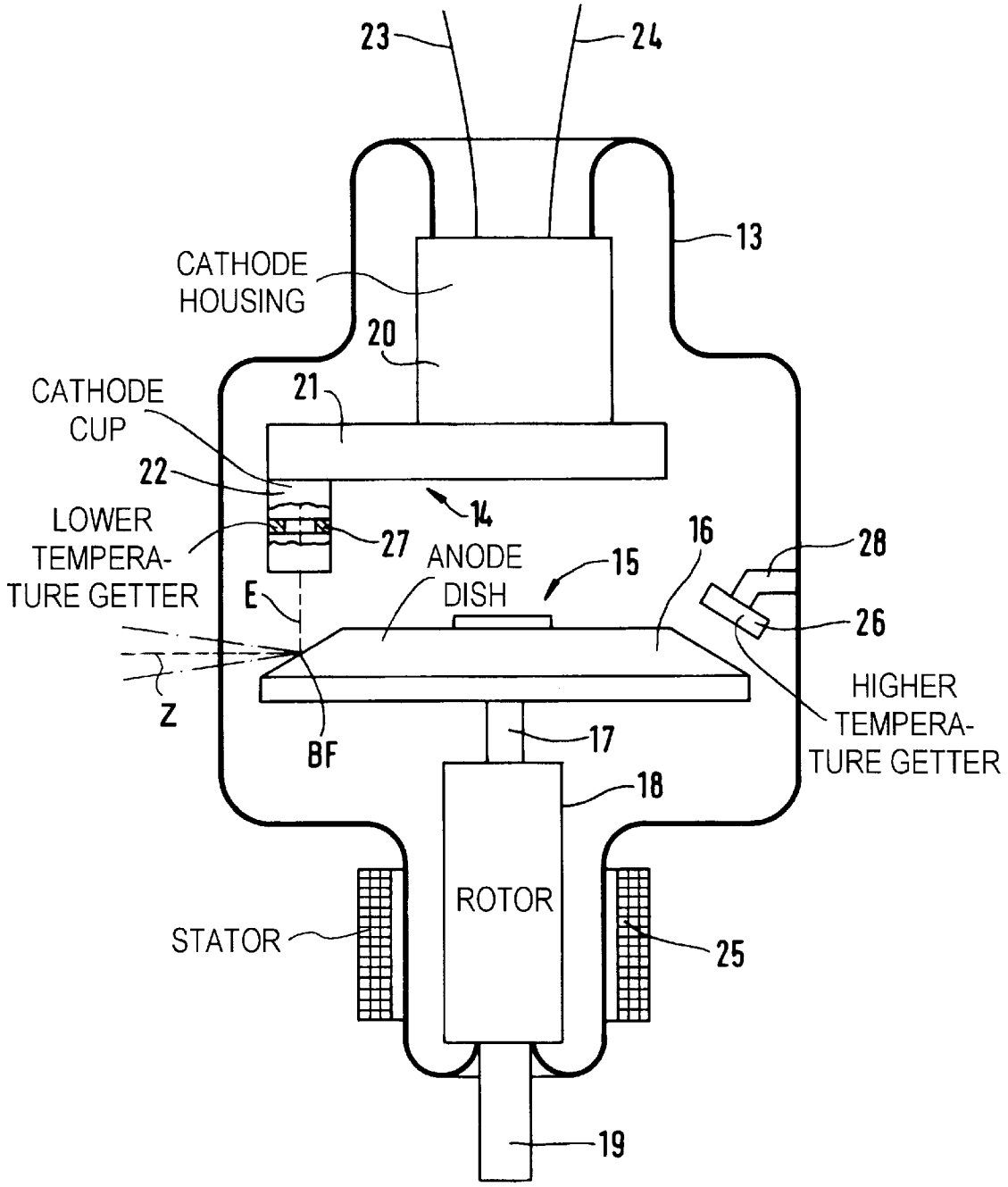
FIG. 2 is a schematic, partly in section views of a second embodiment of the inventive x-ray tube.

FIG. 2 shows a further embodiment of an inventive x-ray tube. The vacuum housing of the x-ray tube is referenced 13. A cathode arrangement referenced 14 overall is arranged at one end thereof. A rotating anode arrangement 15 is located at the other end of the vacuum housing 13. This rotating anode arrangement 15 has an anode with an anode dish 16 that is connected to a rotor 18 with a shaft 17. The rotor 18 is rotatably seated connecting piece 19 in an electrically conducting manner with rolling bearings in a way that is known and not shown. The cathode arrangement 14 includes a cathode housing 20 that is connected vacuum-tight to the vacuum housing 13 and has a projection 21. A cathode cup 22 in which a glow cathode (not visible in FIG. 2) is accepted is provided at the free end thereof. This can be provided with a filament current via terminals 23, 24, so that an electron beam E indicated with broken lines in FIG. 2 emanates from the cathode, this electron beam E striking on the incident surface of the anode dish 13 in the focal spot BF when a tube voltage is produced between the terminal 23 and the connecting piece 19. The generated x-ray beam that passes toward the outside through the vacuum housing 13 proceeds from the focal spot BF. In FIG. 2, the useful x-ray beam (indicated dot-dashed) is shown with the central array Z indicated in broken lines.

In order to avoid an excessive heating of the anode dish 16 in the region of the focal spot BF, the anode dish 16—as in the above-described exemplary embodiment according to FIG. 1—is placed in rotation during the operation of the x-ray tube. This occurs by supplying an electrical stator 25 surrounding the vacuum housing 13 in the region of the rotor 18 with a suitable alternating current such that the stator 25 and the rotor 18, formed of electrically conductive material, interact in the fashion of a squirrel-cage induction motor.

As in the above-described exemplary embodiment, two getters 26 and 27 are provided in the inside of the vacuum housing 13 of the x-ray tube of FIG. 2 for bonding free gases that, after the evacuation of the vacuum housing 13, are released by various components present in the inside of the x-ray tube as a consequence of temperature-caused outgassing during operation of the x-ray tube. These gases are released into the inside of the vacuum housing 13. The getters 26 and 27 correspond to the getters 11 and 12 of FIG. 1 in terms of their function.

The getter 26 is formed of zirconium and, like the getter 11 of FIG. 1, is provided for bonding reactive gases. The getter 26 is arranged at a holder 28 secured to the vacuum housing 13 in the proximity of the anode dish 16. As in the case of the getter 11 of FIG. 1, the getter 26 is thus indirectly heated by the thermal radiation of the anode dish 16 during operation of the x-ray tube and thereby reaches an operating temperature of approximately 400°–500° C., so that diffusion of the reactive gases absorbed at the getter surface into the inside of the getter 26 is accelerated. Differing from the getter 11 of FIG. 1, the getter 26 does not have an annular shape but instead has a circular structure. The getter 26, however, can also exhibit some other type of structure.

The getter 27, like the getter of FIG. 1, is composed of an alloy of zirconium and nickel and is provided for physically dissolving hydrogen that is present as free gas in the inside of the vacuum housing 13 during operation of the x-ray tube. Since, as already mentioned, the solution process of the hydrogen occurs quickly in a getter, even given a comparatively low operating temperature of the getter, and slows down with increasing operating temperature of the getter, the getter 27 is arranged in the cathode cup 22 of the cathode arrangement 14 where it is heated to only a comparatively little extent and exhibits a temperature of approximately 250° C. As in the above-described exemplary embodiment, it is thereby assured that hydrogen enters into solution relatively rapidly in the getter 27, as a result of which the partial hydrogen pressure in the inside of the vacuum housing 13 of the x-ray tube is kept relatively low. The getter 27 has an annular structure, so that the electron beam E emanating from the glow cathode (not shown in FIG. 2) proceeds unimpeded from the glow cathode to the anode dish 16.

Figure 3:
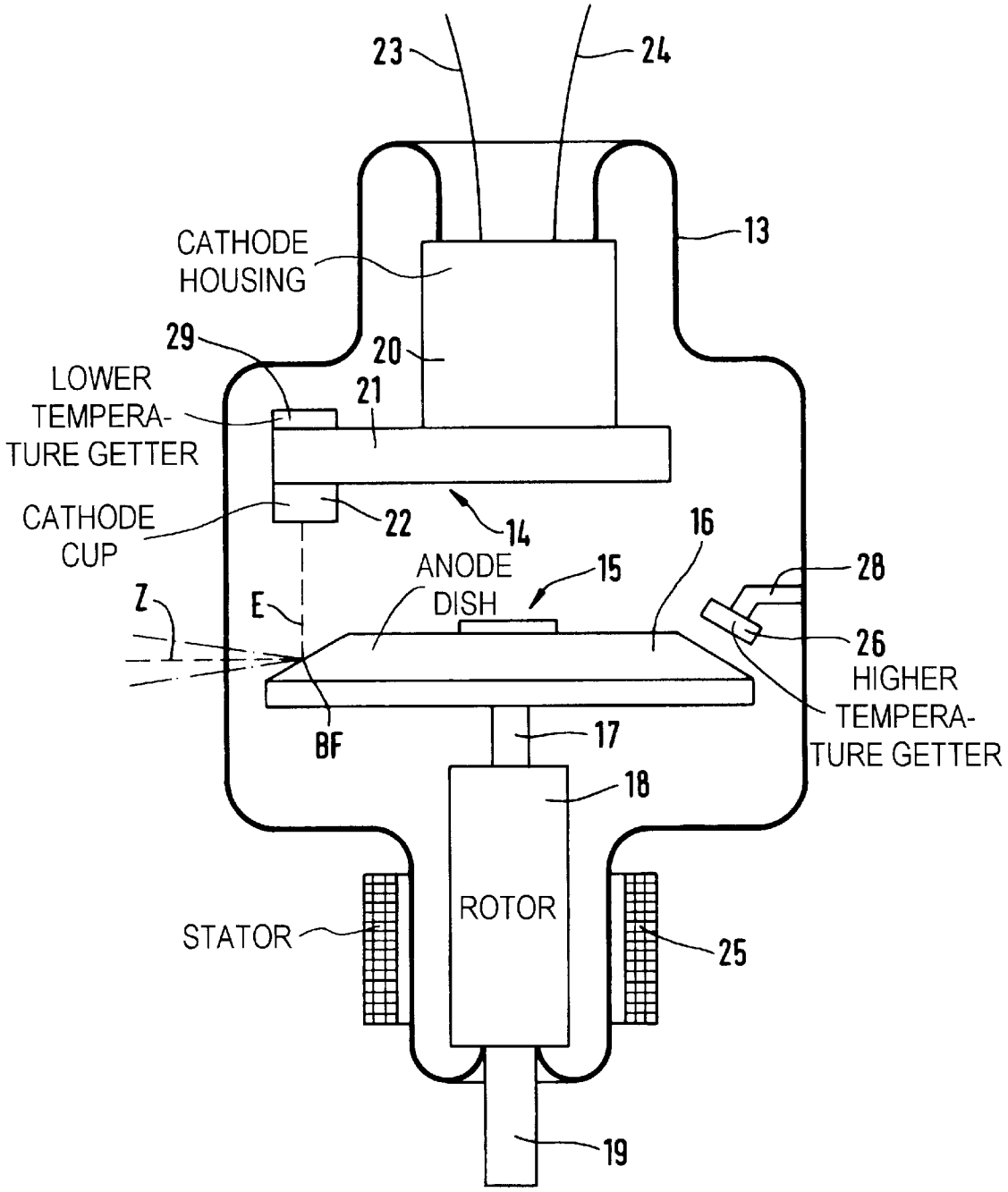
FIG. 3 is a schematic, partly in section view of a third embodiment of the inventive x-ray tube.

FIG. 3 shows a further embodiment of an inventive x-ray tube that essentially corresponds to the embodiment of the x-ray tube of FIG. 2. Components of the x-ray tube of FIG. 3 that are substantially identical to components of the x-ray tube of FIG. 1 are therefore provided with the same reference characters.

Like the x-ray tube of FIG. 2, the x-ray tube of FIG. 3 has a getter 26 neighboring the anode dish 16 for bonding reactive gases having a higher operating temperature during operation of the x-ray tube and comprises a getter 29 for dissolving hydrogen with a comparatively low operating temperature during operation of the x-ray tube. Differing from the x-ray tube of FIG. 2, the getter 29 is not arranged in the cathode cup 22 of the x-ray tube, but is arranged at that side of the projection 21 of the cathode arrangement 14 facing away from the anode. In this way, the getter 29 is likewise heated comparatively little, so that it is assured that hydrogen can enter into solution in the getter 29 relatively well and fast. The getter 29 in this exemplary embodiment has a circular structure but can also be implemented in some other way.

Figure 4:
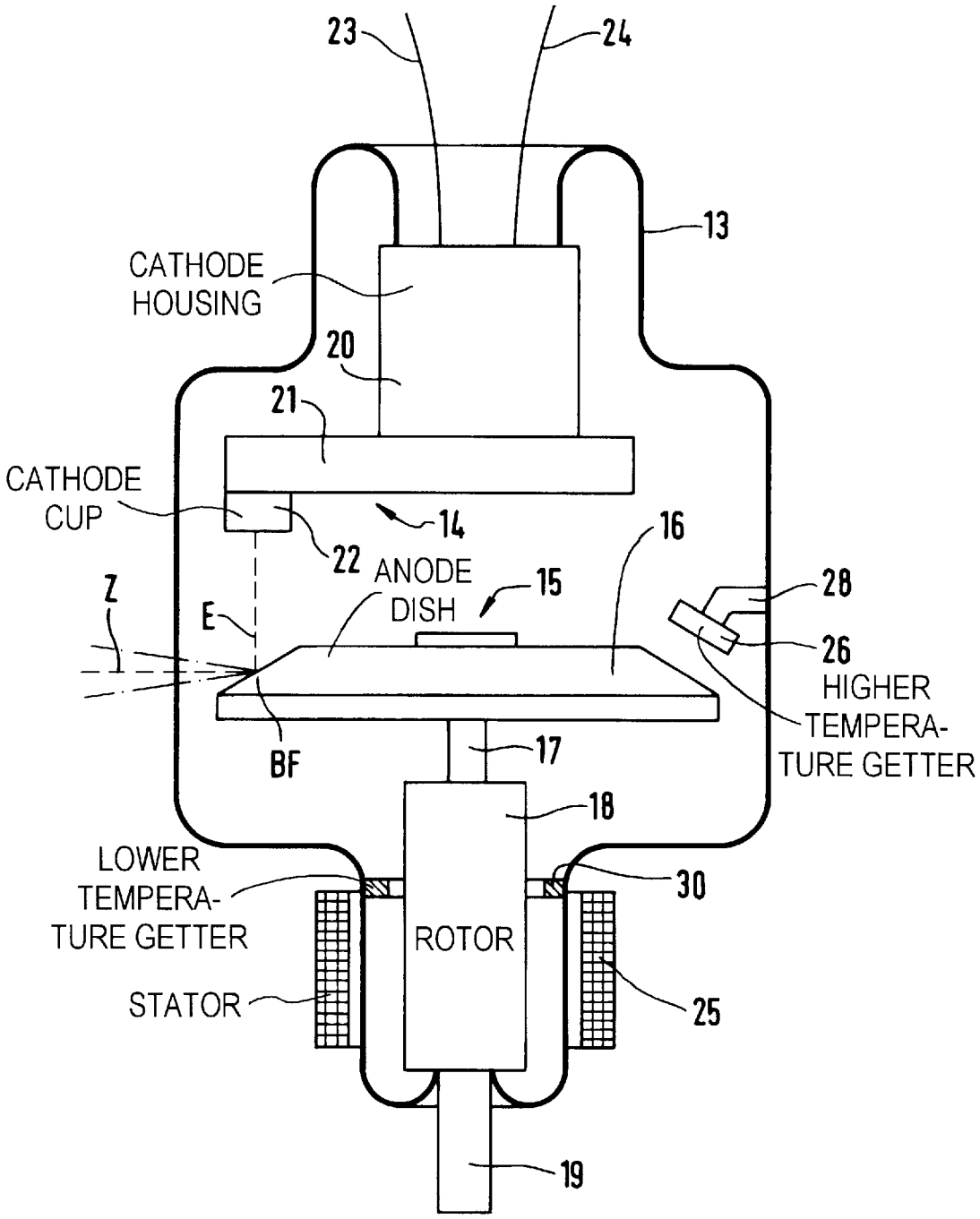
FIG. 4 is a schematic, partly in section views of a fourth embodiment of the inventive x-ray tube.

FIG. 4 shows another embodiment of an x-ray tube whose structure is likewise largely identical to the x-ray tube of FIG. 2. Components of the x-ray tube according to FIG. 4 that are substantially identical to components of the x-ray tube of FIG. 2 are therefore provided with the same reference characters.

Differing from the x-ray tubes according to FIGS. 2 and 3, the getter 30 of the x-ray tube of FIG. 4 provided for dissolving hydrogen is arranged at that side of the anode dish 16 facing away from the cathode. In the case of this exemplary embodiment, the getter 30 has an annular structure and surrounds the rotor 18 of the squirrel-cage induction motor. The getter 30 is thereby secured to the vacuum housing 13 of the x-ray tube. This integration location of the getter 30 is also selected such that the getter 30 is heated only comparatively little by the thermal radiation of the anode dish 16. As a result thereof, it is assured that hydrogen enters into solution in the getter 30 relatively well and fast.

The getter 30, moreover, need not necessarily have an annular structure and surround the rotor 18 but can also be implemented in some other way, whereby it does not surround the rotor 18.

Alloys of zirconium, vanadium and iron, alloys of zirconium and carbon, or alloys of zirconium and aluminum are also suitable as getter materials for the getters 11 and 26. Zirconium, alloys of zirconium, vanadium, and iron, alloys of zirconium, and carbon, alloys of zirconium and aluminum, and alloys of zirconium and nickel can be employed as getter material for the getters 12, 27, 29, 30.

Further, the getters 11, 12, 26, 27, 29, 30—dependent on the structure of the x-ray tube—can also be located at locations other than those recited in the exemplary embodiments. The integration location of the getters should always be selected in view of their operating temperature such that they can respectively develop an optimally high absorbency for reactive gases or hydrogen, respectively.

In this context, there is also the possibility within the scope of the invention of integrating newer than two getters at corresponding locations in the vacuum housing of the x-ray tube for bonding free gases.

Further, the getters need not necessarily be formed of different getter materials; rather, it is also possible to implement both getters of the same getter material.

The structure of x-ray tubes described in conjunction with the exemplary embodiments is provided only as an example. The invention can also be employed in conjunction with x-ray tubes that have a differently constructed x-ray tube with a differently constructed vacuum housing, that can contain a fixed anode instead of a rotating anode.

Moreover, getters must fundamentally be first "activated" in order to develop their highest absorbency. This usually occurs by heating the getters in the vacuum to a getter-specific temperature that, for example, lies at about 900° C. for a getter material like zirconium. To this end, the getters are usually provided with heating coils (not shown in FIG.

1) in the inside of the getter, the leads thereof being conducted electrically insulated out of the x-ray tube. During the evacuation of the vacuum housing of the x-ray tube, the getters are heated via the heating coils, so that oxides superficially adhering to the getters release and can be pumped off. The getters are thus freed of the oxides that superficially adhere to them and are then "activated" after the pumping process. During operation of the x-ray tube, the getters, moreover, can no longer be heated via the heating coils because this would require their insulation to be high-voltage insulation. A high-voltage insulation of the leads would involve an enormous structural outlay that could not be economically justified.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray tube comprising:

a vacuum housing having a housing projection;

an anode disposed in said vacuum housing, said anode, during operation, emitting heat radiation at a heat radiation temperature;

a cathode disposed in said housing projection;

a first getter for bonding free gases arising in said vacuum housing during operation of said x-ray tube, said first getter being disposed in said vacuum housing in a region permeated by said heat radiation and substantially at said heat radiation temperature; and a second getter for bonding free gases arising in said vacuum housing during operation of said x-ray tube, said second getter disposed at a location in said housing projection at a temperature substantially lower during operation than said heat radiation temperature.

2. An x-ray tube as claimed in claim 1 wherein said second getter is comprised of getter material in which hydrogen physically enters into solution.

3. An x-ray tube as claimed in claim 2 wherein said getter material of said second getter is comprised of getter material selected from the group consisting of zirconium, alloys of zirconium, vanadium and iron, alloys of zirconium and carbon, alloys of zirconium and aluminum, and alloys of zirconium and nickel.

4. An x-ray tube as claimed in claim 1 wherein said first getter is comprised of first getter material and said second getter is comprised of second getter material, said first getter material being different from said second getter material.

5. An x-ray tube as claimed in claim 1 wherein said first getter is comprised of getter material which bonds reactive gases entering into strong chemical bonds with said getter material.

6. An x-ray tube as claimed in claim 5 wherein said getter material of said first getter is selected from the group consisting of zirconium, alloys of zirconium, vanadium and iron, alloys of zirconium and carbon, and alloys of zirconium and aluminum.

* * * * *